United States Patent [19]

Millner

[11] Patent Number: 4,771,358

[45] Date of Patent: Sep. 13, 1988

[54] MAGNETIC CHUCK CONTROLLER

[75] Inventor: Alan R. Millner, Lexington, Mass.

[73] Assignee: Walker Magnetics Group, Inc., Worcester, Mass.

[21] Appl. No.: 118,058

[22] Filed: Nov. 9, 1987

[51] Int. Cl.[4] ..... H01F 13/00; H01H 47/00; H01H 50/12

[52] U.S. Cl. ..... 361/145; 361/149; 361/190; 361/205

[58] Field of Search ..... 361/143, 144, 145, 149, 361/190, 205, 267

[56] References Cited

U.S. PATENT DOCUMENTS

| | | | |
|---|---|---|---|
| 1,180,680 | 4/1916 | Walker | 361/145 |
| 3,164,753 | 1/1965 | Schroeder | 361/145 |
| 3,401,313 | 9/1968 | Littwin | 361/145 |
| 4,013,932 | 3/1977 | Aggarwal | 361/145 |
| 4,306,269 | 12/1981 | Bacchiere et al. | 361/149 |
| 4,384,313 | 5/1983 | Steingroeve et al. | 361/149 |
| 4,402,032 | 8/1983 | Wilterdink | 361/145 |
| 4,426,672 | 1/1984 | Armond | 361/145 |
| 4,462,059 | 7/1984 | Yamagami et al. | 361/149 |
| 4,467,388 | 8/1984 | Thoe | 361/145 |
| 4,523,250 | 6/1985 | Bacchiere et al. | 361/145 |
| 4,591,943 | 5/1986 | Armond | 361/145 |

*Primary Examiner*—Michael L. Gellner
*Assistant Examiner*—David Porterfield
*Attorney, Agent, or Firm*—Henry D. Pahl, Jr.

[57] ABSTRACT

In the magnetic chuck control disclosed herein, the chuck winding is selectively energized in one direction or the other through respective triggerable semiconductor current switching devices. Successively reducing current levels are applied in successive phases of operation, the polarity of the current being reversed in successive phases. During a first portion of each phase the device is triggered to apply a corresponding preselectable voltage. During a second portion of each phase the switching devices are triggered quite late to provide an average voltage which opposes the current flow which was induced during the first portion thereby to quickly reduce the level of current flowing in the winding. The current level is sensed to generate a control signal representative thereof and a sequencing means, responsive to the control signal, operates when the current in the winding falls below a preselected value during the latter portion of each phase thereby to terminate the late energization portion and to initiate the application of current in the reverse direction thereby instituting the next phase in the demagnetizing sequence.

8 Claims, 2 Drawing Sheets

MAGNETIC CHUCK CONTROLLER

BACKGROUND OF THE INVENTION

The present invention relates to a magnetic chuck controller and more particularly to such a controller in which current sensing is employed to determine the dissipation of a previously applied current in the chuck winding.

Magnetic chucks are widely utilized in the machine tool industry for holding a work piece which is to be machined or ground. The magnetic chuck is essentially an electro-magnet which is energized to retain the work piece. However, to release the work piece it is typically necessary to provide a demagnetizing sequence, i.e. to reduce the residual magnetism in the chuck and the work piece in order for the work piece to be removed. The demagnetizing sequence typically comprise the application of a succession of successively reducing current levels in successive phases, the polarity of the current being reversed in successive phases. Since the chuck, together with the work piece, constitutes a highly inductive load, the time periods required are relatively long as compared with the typical period of supply line alternating current. Further, in order to demagnetize effectively, time must be allowed for the magnetic flux to penetrate the work piece against the counteracting forces of eddy currents, etc.

In order to shorten the demagnetizing cycle as much as possible, it has previously been proposed to utilize current sensing during the build up of current during each phase in the demagnetizing cycle. Such proposals are for example contained in the Littwin U.S. Pat. No. 3,401,313 and the Wilterdink U.S. Pat. No. 4,402,032. It has been found, however, that this mode of speeding the demagnetizing cycle can reduce the effectiveness of the demagnetizing since it makes no allowance for the time required for the magnetic flex to penetrate the work piece to maximum depth. It has also been proposed to shorten the time required to dissipate a current previously induced in the chuck winding by shunting or "crowbarring" the winding following a period of energization thereof.

While the application of a reverse voltage through a second set of triggerable semiconductor current switching devices would, in theory, more quickly reduce the current flowing, as a practical matter such a technique may induce failures of the semiconductor devices since triggering the second set of devices may produce an effective short across the a.c. supply mains if the first set has not commutated. As is understood by those skilled in the art, it is the nature of an inductive load to freewheel through a triggerable current switching device and keep it forward biased and conducting even though it is not triggered. Thus, though such an arrangement has previously been proposed, i.e. in the Wilterdink patent identified above, there are concomitant problems.

Among the several objects of the present invention may be noted the provision of a novel magnetic chuck controller; the provision of such a controller which facilitates rapid ard complete demagnetization of a chuck and its work piece, notwithstanding variations in the size and magnetic characteristics of the work piece; the provision of such a controller which is highly reliable nothwithstanding the inductive character of the magnetic chuck; the provision of such a controller which is highly flexible in operation; and the provision of such a controller which is of relatively simple and inexpensive construction. Other objects and features will be in part apparent and in part pointed out hereinafter.

SUMMARY OF THE INVENTION

Briefly, apparatus of the present invention operates to demagnetize a work piece of unknown characteristics, using a winding which is magnetically coupled to the work piece, through the application of a sequence of successively reducing current levels in successive phases of operation, the polarity of the current being reversed in successive phases. Triggerable semiconductor current switching devices are utilized for applying direct current of a selectable polarity to the winding from alternating current supply mains. The switching devices are controlled during a first portion of each phase of the demagnetizing sequence for applying a respective preselectable voltage to the winding to develop a corresponding current level. The control means operates during a second portion of each phase to effect late triggering of the semiconductor current switching devices thereby to provide an average voltage which opposes the current flow induced during the first portion of the phase thereby to quickly reduce the level of current flowing in the winding. The level of current in the winding is sensed and a control signal representative thereof is generated. Control means responsive to the control signal and operative when the current in the winding falls below a preselected absolute level during the latter portion of each phase in the demagnetizing sequence terminates the late triggering operation and initiates the application of current in the reverse direction, i.e. initiates the first portion of the next phase in the demagnetizing sequence.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
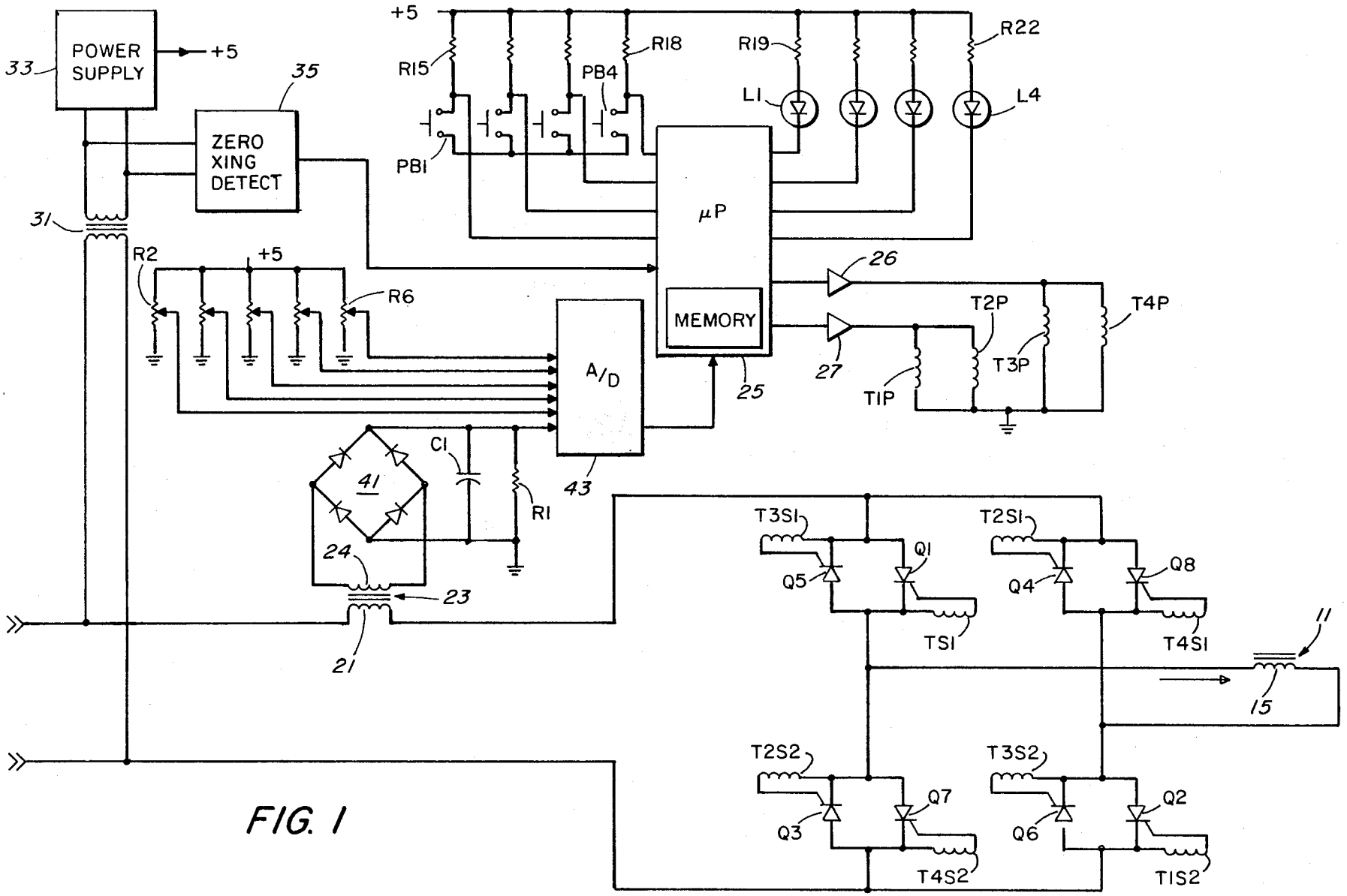
FIG. 1 is a schematic circuit diagram of a magnetic chuck controller constructed in accordance with the present invention.

Referring now to FIG. 1, the magnetic chuck to be controlled by the apparatus of the present invention is designated generally by reference character 11. Chuck 11 includes a winding 13 which is selectively connectable to alternating current supply leads 15 and 17 through triggerable semiconductor current switching devices. In the embodiment illustrated, these triggerable switching devices are silicon controlled rectifiers (SCRs) Q1–Q8. As is understood, if the a.c. supply voltage readily available is not appropriate, a step-up or step-down transformer may be interposed in the a.c. supply circuit. For purposes described in greater detail hereinafter, the primary winding 21 of a current sensing transformer 23 is placed in series with the connection to supply lead 15. By means of this transformer, the current being applied to the chuck 11 may be sensed.

The SCRs Q1–Q8 are triggered through pulse transformers T1–T4. In the embodiment illustrated, each pulse transformer includes a single primary, e.g. T1P, and a pair of secondaries, e.g. T1S1 and T1S2, the SCRs thus being triggered in pairs. For the purpose of simplifying the drawings and the explanation, the various suppression and/or damping networks typically associated with the use of triggering pulse transformers have been omitted in this illustrative drawing. The SCRs are connected in a bridge circuit so that, by triggering an appropriate pair, a current can be applied to the winding 15 in a selected direction on either half cycle of the a.c. supply lines.

Sequencing of the triggering of the various SCR pairs is flexibly controlled by a microprocessor. This microprocessor, together with its associated memory components, is designated generally by reference character 25. Pulse output signals generated by the microprocessor are applied to the primaries of the pulse transformers through driver amplifiers 26 and 27.

A step-down transformer 31 provides a.c. current at a reduced voltage level to a power supply 33 which powers the various integrated circuit components employed in the controller. A zero crossing detector circuit 35 also responds to this a.c. voltage to provide a phase or timing reference to the microprocessor 21.

The secondary winding 24 of current sensing transformer 23 is connected to a diode bridge 41 and the rectified output signal from the bridge 41 is applied to a sense resistor R1 shunted by a filter capacitor C1. The d.c. voltage generated across the capacitor C1 is essentially representative of the current being applied to the chuck 15 through the bridge circuitry comprising SCRs Q1–Q8. In order to provide to the microprocessor 25 a digital value representing this current level, the d.c. voltage across capacitor Cl is applied to an analog-to-digital converter 43 whose output is connected to the microprocessor 25. The analog-to-digital converter 43 is also utilized to digitize preselectable voltage levels provided by a series of potentiometers R2–R6. The first of these is an operator selectable value which is used to produce a reduced or so-called VARIABLE level of energization of the chuck. As is understood in the art, a reduced level of energization is desirable for some machining operations where less than full holding power is required. The other values are typically preset for a given application or installation and provide operating parameters for the micro-computer 25. In the particular embodiment illustrated, the other values determine: an absolute minimum current level which is used as a reference to determine if the chuck winding has open circuited; a relative current level which is used in testing for some component failures; a value which represents the number of steps (pulses) to be taken in the demagnetizing sequence; and the length of time each pulse is to be applied.

To select between the various possible modes of operation provided by the controller of the present invention, four operator actuable push button switches PB1–PB4 are provided. One side of each push button switch is grounded and the other side is connected, through a respective biasing resistor R15–R18, to the 5-volt supply thereby to generate binary signals representative of the state of the respective push button switch. These signals are provided to the microprocessor 25. The states of the switches are read during a background process run by the microcomputer.

To indicate the existing mode of operation of the control, the microprocessor 25 controls four indicator LEDs (light emitting diodes) L1–L4 which are connected to the five volt supply through respective current limiting resistors R19–R22. The four states which can be selected and indicated are conventionally designated FULL (full energization), VARIABLE (variable energization), RESIDUAL (de-energize without demagnetization) and RELEASE (demagnetize).

Figure 2A:
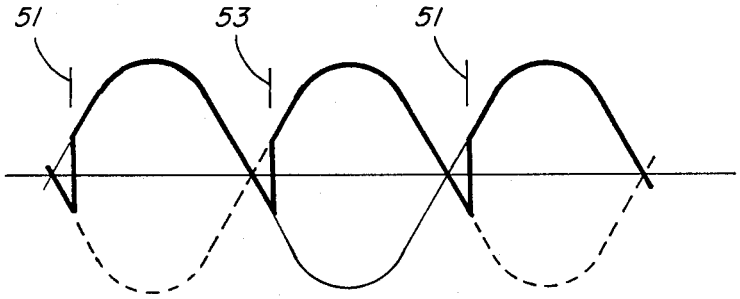
FIGS. 2A–2C are diagrams illustrating the timing of triggering of semiconductor current switching devices utilized in the device of FIG. 1.

To fully energize the chuck 15, the SCRs are selectively energized to apply a current in the direction indicated ty the arrow in FIG. 1. Thus, during the a.c. half cycle when the supply lead 15 is positive, the SCRs Q1 and Q2 are triggered early in the half cycle so that substantially the full positive going waveform drives the desired current flow. Similarly, during the a.c. half cycle when the supply lead 17 is positive, the SCRs Q3 and Q4 are triggered early in the half cycle so that, again, substantially the whole area of the waveform drives current in the forward direction through the chuck winding. This operation is illustrated in FIG. 2A where the point of triggering of the SCRs Q1 and Q2 is designated by reference character 51 and the point of triggering of SCRs Q3 and Q4 is designated by reference character 53. Since the chuck 11 is highly inductive, it will be understood that, once current flow is established, each SCR will remain conductive until the current flow is taken over by the triggering of another SCR, i.e. until commutation takes place. The forward current flow through each SCR will in fact continue even though the corresponding supply lead goes negative, since the inductive reactance to current change will cause the SCR itself to remain forward biased. Thus, the waveform will, in fact, include small negative going portions, i.e. portions which slightly oppose the forward current flow.

Figure 2B:
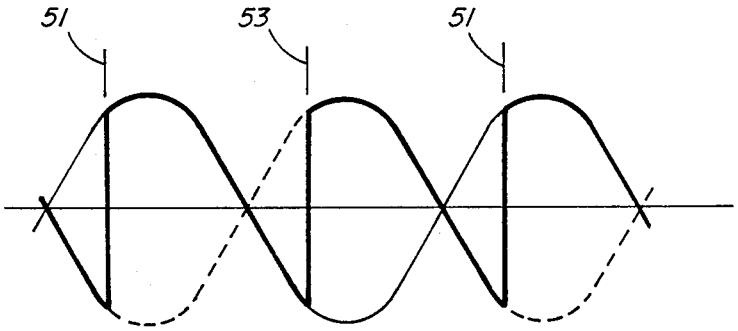

To effect partial or VARIABLE energization, the triggering of the SCRs is delayed as illustrated in FIG. 2B. In this case, the average DC component driving current through the winding is reduced and, in fact, the waveform includes not only positive but significant negative portions.

Figure 2C:
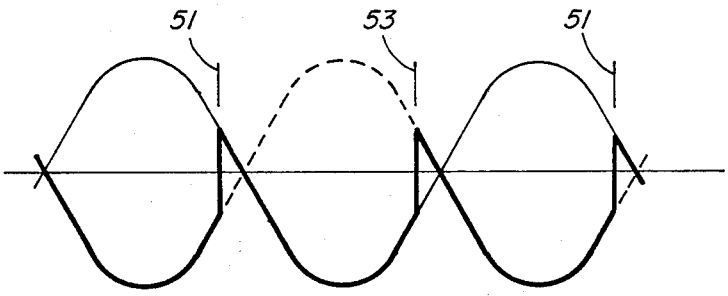

Using these same diode pairs, it is even possible to develop a voltage which significantly opposes a current previously induced through the chuck winding by these same SCR pairs. This mode of operation is important in the overall method of operation of the apparatus of the present invention and is illustrated in FIG. 2C. In this mode of operation, the triggering of the SCRs is delayed until very late in the respective a.c. half cycle, i.e. well after the peak in the a.c. waveform. Although each SCR pair is triggered while the respective supply lead is positive, i.e. so that it can take over from or commutate the other SCR pair, the net waveform is essentially negative and opposes the preexisting current flow. As will be understood by those skilled in the art, this mode of operation will successfully produce an opposing voltage so long as the inductively stored energy is sufficient to maintain the direction of the preexisting current flow. Given the highly inductive nature of magnetic chucks together with their associated work pieces, this mode of operation is, in fact, sustainable for a great many a.c. half cycles.

While it would be possible to merely trigger according to this mode for a sufficient time to guarantee that the current drops below the level at which the SCRs will continue to conduct unless commutated, the present invention substantially shortens this current quenching phase by measuring the actual current flow to the chuck. This measurement is provided by means of the current sensing transformer 23 and the analog-to-digital converter 43 described previously. Thus, the microprocessor can run the SCR bridge in the current quenching mode of FIG. 2C for a period of time which it determines empirically and which will vary in accordance with the magnetic characteristics of the chuck and work piece. In other words, the microprocessor can run the SCR bridge in the FIG. 2C mode until it determines, from the A/D converter 43, that the current being supplied to the bridge has dropped below a programmatically preselected level. From the foregoing, it can be seen that a current of a desired level can be induced in the winding 15 of chuck 11 and that, using the same SCRs which induce the current, the current can be actively quenched, i.e. by a voltage which opposes the current. As will be understood, quenching with an opposing voltage will cause the current level to drop much faster than merely shorting or "crowbarring" the chuck supply leads.

Since the SCR bridge is entirely symmetrical, it can also be seen that a current of programmatically preselectable level can be induced in the reverse direction and then selectively quenched using the same SCRs which induced the current. In generating a reverse current, i.e. a current which is opposite to the arrow in FIG. 1, however, SCRs Q5 and Q6 are triggered during the a.c. half cycle when the supply lead 15 is positive and the SCRs Q7 and Q8 are triggered during the a.c. half cycle when the supply lead 17 is positive. Since the actions are essentially the same on each a.c. half cycle, it is convenient to merely connect the respective primaries in parallel and have the microprocessor generate an appropriate pulse during each half cycle, these pulses being applied through the driver amplifier 27 when a forward current is desired or existing and through the driver amplifier 26 when a reverse current is desired or existing.

Since the quenching phase is active, i.e. a voltage is applied which opposes the existing current flow, the quenching phase can proceed quite quickly. Further, since the time of quenching is not predetermined but determined empirically by means of the current sensing transformer, no time is wasted during the demagnetizing (RELEASE) operation.

While a voltage opposing an existing forward current flow could, in theory, be generated by the SCRs which are utilized to generate a reverse current flow, a substantial danger exists that improper commutation will occur and that the reverse current driving SCRs will be turned on without the forward driving SCRs being commutated off. In this case an effective dead short will exist across the supply leads. This condition, even though momentary, can quickly destroy the SCRs.

In the embodiment illustrated, the microprocessor was a type 8748 from the Intel Corporation of Sunnyvale, California. This device incorporates EPROM memory so that the operating program can be permanently stored in the device itself. The actual program under which the microprocessor operates is set forth, in source code form, in an appendix to this application.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

- A P P E N D I X -

```
        ;CHUCK CONTROL PROGRAM-FOR C VERSION
        ;CREATED:FEB 1987
        ;from revision 17:40:08  2/5/1987 MSD3004
        ;add multiplier for min delay time
        ;leave release light on at end of cycle
        ;from revision 9:12:11  3/11/1987 MSE1005
        ;add VR4 on Rev 1 ckt board
        ;change table of constants for release
        ;last revision 11:33:12  4/20/1987 MSC1010
        ;change maxdly by 160 usec to reduce min variable level
        ;change lockout function so that INT bit is reset
        ;increase release point to 117mv
        ;CHANGE RELEASE PULSE TIME TO 0-2 SEC
        ;drop out min variable to zero at 2 (40mv)
        ;last revision 8/12/87 MSC1014

                ;INITALIZATION

                ;constants
PNKCUR  EQU 6BH ;panik current (150W = 4BH, 300W = 6BH,500W=0BH)fix

                ;MAKE SURE YOU CHANGE THIS VALUE FOR 220V VERSION (68)
MULTD   EQU 15  ;min delay timer multiplier(15 for 150W, 23 for 300,500W)fix
                ;mindly = 256 - period*multd/256

                ;Registers
SLASK   EQU R0  ;Temporary storage
GARBAGE EQU R1  ; -"-
TRACH   EQU R2  ; -"-
REG3    EQU R3  ;
REG4    EQU R4  ;
STREG   EQU R5  ;Statusregister
                ;bit0   RELEASE      Bit 0 - bit 3 are used to keep track
                ;bit1   RESIDUAL          of which button was pressed
```

```
                ;bit2   VARIABLE LEVEL
                ;bit3   FULL
                ;bit4   BUTTON PUSHED      If high button pressed
                ;bit5   PART RELEASED      If high part released
                ;Bit6   CURRENT SENSE      If high part released
                ;bit7   STATUS LOCK OUT    If low then lock out (not used?)
REREG   EQU R6  ;Statusregister for release
                ;bit0   KEEP TRACK        Binary counter which tells
                ;bit1    OF MODE                the mode
                ;bit2   NEW STEPM    High indicates first pass through after
                ;                        beginning new demag pulse.
                ;bit3   INTERRUPT    If high the there has been an interrupt
                ;bit4   NEW OFF     High = first pass thru after beginning off.
                ;bit5   NEW RAMP    High = first pass thru after beginning ramp.
                ;bit6   NEW PULS
                ;bit7   YNFIRE            If high fire scr's
MAXDLY  EQU R7  ; 60 = 160 , 50 = 139
                ;MAXDLY = 264 - PERIOD / 160 uSec
                ;Storage locations
PORT1   EQU 60  ;mask used to light lamps

CHVLT   EQU 58  ;Chuckvoltage

CHUCKM  EQU 57  ;chuck - from IN7

CHUCKP  EQU 56  ;chuck + from IN6

CNLVL2  EQU 55  ;current sense amp level, read from pot VR4

CNLVL1  EQU 54  ;current null level,read from pot VR3

STPTM   EQU 53  ;Step setteling time, read from pot VR2 (external)

NSTPS   EQU 52  ;Number of steps read, read from the pot VR1

VARLVL  EQU 51  ;the from pot read varlevel

CRLVL   EQU 50  ;current level,read from the adc

TEMP6   EQU 46
TEMP5   EQU 45  ;temporary storage
TEMP4   EQU 44
TEMP3   EQU 43
TEMP2   EQU 42
TEMP1   EQU 41

MINDLY  EQU 40  ;min delay value as modified by the period

NCYCLE  EQU 39  ;Counter for pulsmode in release mode
                ;gives number of AC half-cycles in each
                ;pulse

STCYCLE EQU 38  ;Count the number of steps in releascycle

TIMER   EQU 37  ;Contains the correct value that shall
                ;be loaded into the timer

TIMERO  EQU 36  ;timer value from mag> cycle

TRESID  EQU 35  ;truw residual register
                ;bit 7 = 0 : no previous tresid
                ;bit 7 = 1 : previous tresid
                ;bit 6 = 0 : not doing tresid pulse
                ;bit 6 = 1 : doing tresid pulse
ADCAD   EQU 34  ;address the adc

                ;0-7 = RB0 (R0,R1,R2,R3,R4,R5,R6,R7)
                ;8-23 = PROGRAM COUNTER STACK (used during interrupts)
                ;24-31 = RB1 (R0',R1',R2',R3',R4',R5',R6',R7')
```

```
BEGIN
        ORG 0   ;reset interrupt location
        JMP INIT
        ORG 3   ;external interrupt location
        JMP ZCRSUB
        ORG 7   ;timer interrupt location
        JMP TINTSUB
        DB "MSC1014"    ;fix
        DB "08/12/87"   ;fix
INIT
        SEL RB0
        DIS I                   ;Disabel external interrupt
        DIS TCNTI               ;Disabel internal interrupt
        ORL P2,#11110000B       ;make sure scr`s are off
                                ;at power up.

        ANL P1,#0               ;reset the d flip flop
        ORL P1,#%00010001       ;
        MOV SLASK,#PORT1        ;set port1 to release lamp
        MOV @SLASK,#%00010000
        MOV STREG,#%00100001    ;Reset statusregister to set
                                ;release high ,streg indicate that
                                ;release is pressed when program is
                                ;reset.
        CLR F0                  ;To reset the f0 flagg
                                ;When f0 are 0 the current through
                                ;the chuck shall be positive
        MOV REREG,#1            ;init the release register

NNP
        CLR A
        MOV R1,A                ;clear average
        MOV R2,#5               ;clear last value (timer minus 99)
        MOV R4,#4               ;initialize counter for average
        MOV T,A
        EN I                    ;Enabel external interrupt,i.e
                                ;zerocrossing interrupt
        STRT T                  ;start timer
W1      MOV A,REREG
        ANL A,#8
        JZ W1                   ;wait for interrupt
        MOV REREG,#1            ;reset release register
        SEL RB1
        MOV A,MAXDLY            ;timer value at zerocrossing
        SEL RB0
        ADD A,#157              ;normalize to 63 hertz
        JNC W1                  ;frequency too high
        XCH A,R2                ;swap with last value
        CPL A                   ;get ready to subtract last value
        ADD A,R2                ;subtract last value
        ADD A,#4
        ADD A,#$F8              ;make sure period hasn't changed more than 560us
        JC W1                   ;no go - glitch or change of frequency - let it
settle
        MOV A,R2                ;get new value
        ADD A,R1                ;add to average
        MOV R1,A                ;save

        DJNZ R4,W1              ;check count, if not 4, repeat
        CLR C
        RRC A
        CLR C
        RRC A                   ;divide by 4
        MOV GARBAGE,A           ;save temporarily for mindly
        CPL A
        ADD A,#162              ;convert to delay timer value
        MOV MAXDLY,A            ;store value
        ADD A,#94               ;max freq 63
        JC INIT                 ;no go - too high
        ADD A,#34               ;min freq 47
        JNC INIT                ;no go - too low
        STOP TCNT
```

```
        MOV A,#MULTD
        XCH A,GARBAGE
        ADD A,#99               ;result is period in 80usec units(half cycle)
        CALL MULAG              ;multiply period * multd / 256
        CPL A
        INC A
        MOV SLASK,#MINDLY
        MOV @SLASK,A            ;store min delay timer value(250 for 150W 60Hz)

                                ;END OF INITALIZATION

MAINLOOP                        ;Mainloop contains the background
                                ;program
        JF0 LOOK                ;test if current is negative
        CALL READPOT
        CALL RDBSUB             ;
LOOK    CALL EXECUTE            ;THEN DON'T READPOT AND RDBSUB.
        CALL READVLT
WAIT    MOV A,REREG             ;Wait until there has been a
        JZ LOOK
        ANL A,#%00001000        ;zerocrossing
        JZ WAIT
        MOV A,REREG
        ANL A,#%11110111        ;RESET interrupt bit
        MOV REREG,A
                                ;test if lockout is high
        IN A,P1
        ANL A,#%00001000
        JZ LOOK

        JMP MAINLOOP            ;END OF MAINLOOP
READPOT                         ;READ THE POTENTIOMETERS
                                ;Add data for simulator-see rev 0
        MOV R4,#5
        MOV SLASK,#ADCAD        ;adcad tells the address to the adc
        MOV @SLASK,#1
        MOV GARBAGE,#VARLVL     ;Garbage keep track of the memory
L1      MOV A,REREG             ;location werw the data shall be stored
        ANL A,#%11110111        ;reset interrupt bit
        MOV REREG,A

        CALL READADC            ;Read pot
        MOV R3,A
        MOV A,REREG             ;Test if there has been an interrupt
        ANL A,#%00001000        ;If interrupt read again
        JNZ L1
        MOV A,R3
        MOV @GARBAGE,A          ;Save the read value in memory location
        INC GARBAGE             ;Change memory location
        INC @SLASK              ;Increment to get the next address
        DJNZ R4,L1              ;Decrement the counter
        RET


READADC
        MOV SLASK,#ADCAD        ;mux address moved to acc.
        MOV A,@SLASK

        OUTL BUS,A              ;address is moved to the bus
        ORL P1,#%00000100       ;enabel adc ale
        ANL P1,#%11111011       ;disabel adc ale
        ORL P1, #00000010B      ;set adc select line, bit1
        MOV A,#$FF
        MOVX @SLASK,A           ;unlatch bus,dummy write
        ANL P1, #11111101B      ;reset adc select line bit1

EOCLP
        JNT0 EOCLP              ;wait for eoc pulse from adc
```

```
ORL P1, #00000010B;      ;set adc select line, bit0
INS A,BUS                ;inputs data from adc
ANL P1, #11111101B       ;resets adc select line, bit0
RET
RDBSUB                                ;READ THE PUSHBUTTONS

        MOV SLASK,#PORT1
        MOV A,STREG                   ;Save the old statusregister
        ANL A,#%11100000              ;Set bit4=0,wich indicate that no
                                      ;button is read
        MOV GARBAGE,A                 ;save rest of status register
        ORL P1,#%11111000             ;Unlatch port 1
        IN A,P1                       ;Read port 1
        MOV TRACH,A                   ;Push read data
                                      ;To light correct lamp
        ANL A,#%00001111              ;however, during negative ramps
        ORL A,@SLASK                  ;and pulses P1 is not serviced.
        OUTL P1,A                     ;port is high for 18usec
        MOV A,TRACH                   ;Pull read data
        SWAP A                        ;put button data in the right place
        CPL A
        ANL A,#$0F
        ORL A,GARBAGE                 ;get rest of streg
        MOV GARBAGE,A                 ;save new status register
        MOV R4,#4                     ;check for button pressed
TEST1   RRC A                         ;check next button
        JNC NOBUTN                    ;this button has not been pressed
        MOV SLASK,A
        MOV A,GARBAGE
        ANL A,#%00010000
        JNZ TWOBT                     ;two buttons have been pressed
        MOV A,GARBAGE
        ORL A,#%00010000
        MOV GARBAGE,A                 ;update the new streg
        MOV A,SLASK
NOBUTN
        DJNZ R4,TEST1
        MOV A,GARBAGE
        ANL A,#%00010000
        JZ TWOBT                      ;none of the buttons were pressed
        MOV A,GARBAGE                 ;use this as the new streg
        MOV STREG,A

TWOBT   RET                           ;END OF READBUTTONSUBROUTINE
;       ORG $100
EXECUTE
        MOV A,REREG                   ;check for panik mode
        JNZ SELOP                     ;no panik
        MOV SLASK,#NCYCLE             ;use NCYCLE/4 to make the lights blink
        MOV A,@SLASK
        ANL A,#%01000000
        ANL P1,#%00001111             ;turn all the lights off
        JZ IZPNK
SELOP

        MOV SLASK,#PORT1              ;Select the operationsmode
        IN A,P1                       ;Light the correct light
        ANL A,#%00001111
        ORL A,@SLASK                  ;use light stored @port1
        OUTL P1,A
IZPNK   MOV A,STREG                   ;Recall the operation mode
        RRC A
        JNC GGG
        JMP RELEASE
GGG     RRC A
        JC RESID
KKK     RRC A
        JC VRBLVL
OOO     RRC A
        JC FLLVL
TYST    JMP RDBSUB
```

```
READVLT
        MOV GARBAGE,#ADCAD      ;Move the address for the adc into adcad
        MOV @GARBAGE,#6
        CALL READADC            ;Read the positive potential from adc
        MOV SLASK,#CHVLT
        MOV @SLASK,A
        INC @GARBAGE
        CALL READADC            ;Read the negative potential from adc
        CPL A                   ;take 2-complementet of the negative
        INC A                   ;potential and add the positive
        MOV SLASK,#CHVLT        ;potential
        ADD A,@SLASK
        MOV @SLASK,A
        RET
RESID                           ;!!!TRUE RESIDUAL!!!
        MOV A,REREG             ;reset rereg so release will
        JZ FINTRU               ;(hold in panik mode)
        ORL A,#%00000001        ;reinitialize itself if interrupted.
        ANL A,#%10001001        ;do not change Y/Nfire or int flag
        MOV REREG,A

                                ;JZ = true residual, JNZ = not.
        JZ NOTTRU               ;true residual means magnetize fully
                                ;before removing voltage from chuck.
        MOV SLASK, #TRESID      ;to test resid status
        MOV A, @SLASK
        RLC A                   ;to test bit 7 : 0 = no previous tresid
                                ;1 = previous tresid.
        JC NOTTRU               ;if tresid has already been done don't
                                ;do it again.
        RLC A                   ;to test new pulse bit 6 :
                                ;0 = tresid not in progress
                                ;1 = tresid in progress.
        JC OLDTRES              ;if tresid in progress
        MOV A,STREG             ;To clear part released signal
        ANL A,#%11011111
        MOV STREG,A
        ANL P2,#%11101111       ;To set released signal low

        MOV @SLASK, #$40        ;tresid is now in progress.
        MOV SLASK, #STPTM       ;value read from pot = AC half cycles
                                ;needed to magnetize chuck * 2.
        MOV A, @SLASK

        MOV SLASK, #NCYCLE      ;ncycle will count zero crossings
                                ;based on the number generated above.
        MOV @SLASK,A
OLDTRES
        MOV SLASK, #NCYCLE      ;to test if enough halfcycles were done.
        MOV A, @SLASK
        JZ NOTTRU               ;if tresid is complete.
        CLR F0                  ;set positive firing direction.
        MOV SLASK,#MINDLY
        MOV A,@SLASK            ;get mindelay value
        MOV SLASK, #TIMER
        MOV @SLASK, A           ;set timer for minimum delay
        MOV SLASK, #TIMER0
        MOV @SLASK, A           ;set timer0 for minimum delay.
        MOV SLASK, #VARLVL
        MOV @SLASK, #200        ;set variable level to maximum.
        MOV A, REREG
        ORL A,#%10000000        ;set y/n fire to fire SCR's.
        MOV REREG,A
        JMP FINTRU
        MOV SLASK, #TRESID
        MOV @SLASK, #$80        ;set bit 7 to indicate previous
                                ;tresid. reset bit 6 to show
                                ;tresid is not in progress.
        MOV SLASK, #PORT1
        MOV @SLASK, #%00100000  ;light the residual lamp after
                                ;process is complete.
        MOV A,REREG             ;Set YNFIRE=0
        ANL A,#%01111111
        MOV REREG,A
```

```
FINTRU
        ORL P2,#%00100000        ;Set current sence to high to
                                 ;indicate that there is no current

        RET

FLLVL

        MOV SLASK, #TRESID       ;reset true residual register
        MOV @SLASK, #%00000000   ;to reinitialize if interrrupted.
        MOV A,REREG              ;reset rereg so release will
        ORL A,#%00000001         ;reinitialize itself if interrupted.
        ANL A,#%10001001         ;do not change Y/Nfire or int flag
        MOV REREG,A

        MOV SLASK,#PORT1         ;To light the full lamp
        MOV A,@SLASK
        ANL A,#%10000000         ;turn off all the other lights
        MOV @SLASK,A
        IN A,P2                  ;CC MODEL C
        ANL A,#%00100000         ;CC MODEL C
        ;CLR A  ;B model only fix
        JZ FLLT          ;CC MODEL C


        MOV GARBAGE,#NCYCLE
        MOV A,@GARBAGE
        JNZ NFLCHG

                ;make the full light flash

        MOV A,MAXDLY
        CLR C
        RRC A            ;divide by 2
        MOV @GARBAGE,A
        MOV A,@SLASK
FLLT
        XRL A,#%10000000         ;toggle light
        MOV @SLASK,A
NFLCHG


        MOV A,STREG              ;To clear part released signal
        ANL A,#%11011111
        MOV STREG,A
        ANL P2,#%11101111        ;To set released signal low
        CLR F0                   ;Set F0=0 for possitive current
        MOV SLASK,#MINDLY
        MOV A,@SLASK             ;get mindelay value
        MOV SLASK,#TIMER
        MOV @SLASK,A             ;Load minimum delay time into timer
        MOV SLASK,#TIMER0
        MOV @SLASK,A
        MOV SLASK,#VARLVL        ;Load varlvl with the value corr. full level
        MOV @SLASK,#200
        CALL READI               ;Test if current are bigger than treshhold
        MOV A,REREG              ;Set YNFIRE=1
        ORL A,#%10000000
        MOV REREG,A

        RET

VRBLVL
        MOV SLASK, #TRESID       ;reset true residual register
        MOV @SLASK, #%00000000   ;to reinitialize if interrrupted.
        MOV A,REREG              ;reset rereg so release will
        ORL A,#%00000001         ;reinitialize itself if interrupted.
        ANL A,#%10001001         ;do not change Y/Nfire or int flag
        MOV REREG,A

                                 ;Get the value of the varible
                                 ;level from the adc read from the pot
```

```
MOV SLASK,#PORT1          ;To light the variable lamp
MOV A,@SLASK
ANL A,#%01000000          ;turn off all the other lights
MOV @SLASK,A

IN A,P2
ANL A,#%00100000          ;check current bit
;CLR A            ;B model only fix
                          ;flash if current is below CNLVL
JZ SETLITE                ;turn on if above the null level
MOV GARBAGE,#NCYCLE
MOV A,@GARBAGE
JNZ NCHG
                                  ;make the variable light flash

        MOV A,MAXDLY
        CLR C
        RRC A                     ;divide by 2
        MOV @GARBAGE,A
        MOV A,@SLASK
SETLITE
        XRL A,#%01000000          ;toggle light
        MOV @SLASK,A
NCHG
        MOV A,STREG               ;To clear part released signal
        ANL A,#%11011111
        MOV STREG,A
        ANL P2,#%11101111         ;To set released signal low

        CLR F0                    ;Set current direction to positive

                                  ;test if lockout is high
        IN A,P1
        ANL A,#%00001000          ;if so don't alter VARLVL.



        JNZ VUUK
        JMP VLCK                          ;or timer values.
VUUK

        MOV SLASK,#VARLVL
        MOV A,@SLASK
        ADD A,#245                ;If level < 10 then set level=10
        JC LOAD2
        MOV @SLASK,#10

        ADD A,#8                  ;If level < 2 then shut off scr's
        JC LOAD2
        MOV A,REREG
        ANL A,#%01111111
        JMP VLCK1

LOAD2
        MOV A,@SLASK
        ADD A,#246                ;Subtract 10
        ADD A,MAXDLY              ;Add MAXDLY to get the delay time
        MOV GARBAGE, #MINDLY
        JC LMIN
NLMIN   MOV SLASK,A
        MOV A,@GARBAGE
        CPL A
        ADD A,SLASK               ;compare with min timer delay
        MOV A,SLASK
        JNC LOAD1
LMIN    MOV A,@GARBAGE
LOAD1   MOV SLASK,#TIMER
        MOV @SLASK,A
        MOV SLASK,#TIMER0         ;Save timer in timer0
        MOV @SLASK,A

        MOV A,REREG
        ORL A,#%10000000          ;Set YNFIRE=1
```

```
VLCK1   MOV REREG,A
VLCK
        CALL READI              ;Test if current are bigger then trechhold

        RET


RELEASE
        MOV SLASK, #TRESID      ;reset true residual register
        MOV @SLASK, #%00000000  ;to reinitialize if interrrupted.
        ORL P2,#%00100000       ;Set current sence to indicate
                                ;that there is no current
                                ;REREG bit 1,0 used for release mode
                                ;00 panik
                                ;01 ramp
                                ;10 off
                                ;11 puls

        MOV A,REREG             ;Set NO INT to 0
        ANL A,#%11110111
        MOV REREG,A
        MOV SLASK,#PORT1        ;turn off lights by setting = 0
        MOV @SLASK,#%00010000
        MOV A,STREG             ;Test if part released
        ANL A,#%00100000        ;if released jump back to mainloop
        JNZ ZZZZ
        MOV @SLASK,#%00010000   ;Change port1 to light release lamp
NLK     MOV A,REREG             ;Test if puls.
        ANL A,#%00000011        ;If not puls jmp to test of ramp
        ADD A,#$FD
        JNZ XXXX
PULSE   MOV SLASK,#PORT1        ;turn on rel. led during puls mode
        MOV @SLASK,#%00010000   ;to flash during release time.
        ORL P1,#%00010000       ;TURN ON LED REGARDLESS DURING PULSE
        MOV A,REREG             ;Test if New Puls
        ANL A,#%01000000
        JNZ YYYY                ;If New Puls then
ZAZ     MOV A,REREG
        ORL A,#%01000000        ;set New Puls=1
        ANL A,#%11001111        ;set new off=0: new ramp=0
        MOV REREG,A
        MOV SLASK,#STPTM        ;set NCYCLE=STPTM/2
        MOV A,@SLASK
                                ; FOR 2 SEC MAX PULSE
        MOV SLASK,#NCYCLE
        MOV @SLASK,A
        CPL F0                  ;Change current direction
DODA
        CALL TVAL               ;Calculate the correct value for timer
        MOV SLASK,A             ;push A to slask
        MOV A,REREG             ;Test if there has been a zerocrossing
        ANL A,#%00001000        ;interrupt while reading from adc
        JNZ DODA
MIM     MOV A,SLASK             ;pull a from slask

        MOV SLASK,#TIMER
        MOV @SLASK,A            ;save timervalue
        MOV SLASK,#TIMER0       ;compere the calculated timer value
        MOV A,@SLASK            ; with the old timervalue from
        CLR C                   ;clear carry
        CPL A                   ;full or variable level
        INC A                   ;If the old value is smaller then the
        MOV SLASK,#TIMER        ;calculated skipp this puls
        ADD A,@SLASK
        JNC YYYY                ;cont unless skipping pulse
        MOV A, REREG            ;set new pulse=0
        ANL A, #%10111111       ;when pulse is skipped
        MOV REREG,A
        CPL F0                  ;so first demag pulse will alway
                                ;be in the negative direction.
        JMP DECST               ;skip pulse
```

```
YYYY    MOV A,REREG             ;set YNFIRE=1
        ORL A,#%10000000
        MOV REREG,A
        MOV SLASK,#NCYCLE       ;Test if NCYCLE=0
        MOV A,@SLASK
        JNZ ZZZZ                ;If not 0 jmp to test of ramp else
BBBB    MOV A,REREG             ;Set mode to ramp
        ANL A,#%11111101
        MOV REREG,A
        JMP ZZZZ                ;end of pulse mode.
XXXX    MOV A,REREG             ;Test  if ramp
        ANL A,#%00000011
        ADD A,#$FF
        JNZ UUUU                ;If not ramp jmp the test off
RAMP    MOV A,REREG             ;Test if New Step
        ANL A,#%00000100
        JNZ CCCC                ;If New Step then
SLUT    MOV SLASK,#NSTPS        ;set STCYCLE to it's initsial value
                                ;NSTPS/16. (NSTPS is read from pot)
        MOV A,@SLASK
        ANL A,#$F0
        SWAP A
        ADD A,#2                ;corrects stcycle so steps will be
                                ;1 to 16 after decrement in "off".
        MOV SLASK,#STCYCLE
        MOV @SLASK,A
        MOV A,REREG             ;set New Step=1
        ORL A,#%00000100
        MOV REREG,A
CCCC    MOV A,REREG
        ANL A,#%00100000
        JNZ VVVV                ;Test if New Ramp
        MOV A,REREG             ;If New Ramp then
        ORL A,#%00100000        ;set New Ramp=1
        ANL A,#%10101111        ;set New Puls=0
        MOV REREG,A
        MOV SLASK,#TIMER        ;set timer to maximum delay
        MOV A,MAXDLY
        MOV @SLASK,A            ;MAXDLY=maximum delay (160 for 60 hertz)
VVVV    MOV A,REREG             ;set YNFIRE=1
        ORL A,#%10000000
        MOV REREG,A

        ANL P1,#%11101111       ;TURN OFF LED REGARDLESS DURING RAMP

        MOV A,#$FA              ;data sets the level of
                                ;current at which a ramp
                                ;will end. ($FA=6 ie 117mv)
        CLR C
        MOV SLASK,#CRLVL
        ADD A,@SLASK
        JC ZZZZ
HEJ     MOV A,REREG
        INC A
        MOV REREG,A
        JMP ZZZZ                ;end of release.

UUUU    MOV A,REREG             ;Test if off
        ANL A,#3
        ADD A,#$FE
        JZ OFF
        JMP RDBSUB              ;If not off jmp to readbuttonsub
OFF     MOV A,REREG             ;Test if New off
        ANL A,#%00010000
        JNZ QQQQ                ;If New Off=0 then
TYT     MOV A,REREG             ;set New Off=1
        ORL A,#%00010000        ;set New Ramp=0
        ANL A,#%00011111        ;set YNFIRE=0
        MOV REREG,A
        MOV SLASK,#NCYCLE
        MOV @SLASK,#$30         ;CC MODEL C,D load NCYCLE=30H B=78H fix
QQQQ    MOV SLASK,#NCYCLE       ;If NCYCLE=0 then
        MOV A,@SLASK
        ANL P1,#%11101111       ;turn off light during off
```

```
        JNZ ZZZZ
LOL     MOV A,REREG             ;set mode=pulse
                                ;off mode=2, pulse=3
        INC A
        MOV REREG,A
DECST   MOV SLASK,#STCYCLE
        MOV A,@SLASK
        DEC A                   ;decrement stcycle, next pulse
        MOV @SLASK,A
        JNZ ZZZZ                ;When end off release cycle
GHG     ORL P2,#%00010000       ;set released signal = high
        MOV REREG,#1
        MOV A,STREG
        ORL A,#%00100000
        MOV STREG,A
        CLR F0

ZZZZ
        RET


TVAL                            ;Calclate the timer value
        MOV SLASK,#NSTPS        ;Input data to mul are A and GARBAGE
        MOV A,@SLASK
        SWAP A
        ORL A,#$F0              ;Fetch the constant from the ROM
        MOVP3 A,@A
                                ;Multiplies STCYCLE and 1/1+NSTPS
        MOV GARBAGE,A           ;output from mul is the least
        MOV SLASK,#STCYCLE      ;significant byte
        MOV A,@SLASK
        CALL MULAG              ;which multiplies A*GARBAGE
                                ;Multiplies the result from the previous
                                ;multiplication and (the original timer
                                ;value -156)
        MOV A,MAXDLY
        CPL A
        MOV SLASK,#MINDLY
        ADD A,@SLASK
        CALL MULAG              ;output from mul is the most
                                ;significant byte
                                ;To get the actuall value that
        ADD A,MAXDLY            ;is to be loaded into timer
        MOV SLASK,#TIMER        ;add 156 to the result.
        MOV @SLASK,A
        RET


MULAG
                                ;routine to multiply contents of
                                ;A x r1 bank0
                                ;result in R1 lsb, A msb
                                ;uses acc,cy
        MOV SLASK,#TEMP6        ;push a into location 46
        MOV @SLASK,A
        DEC SLASK
        MOV A,R5                ;push R5 into location 45
        MOV @SLASK,A
        DEC SLASK
        MOV A,R4                ;push R4 into location 44
        MOV @SLASK,A
        DEC SLASK
        MOV A,R3                ;push R3 into location 43
        MOV @SLASK,A
        MOV SLASK,#TEMP6        ;move a from location 46 to R0
        MOV A,@SLASK
        MOV R0,A
```

```
MPY
        CLR     A
        CLR     C
        MOV     R4,A        ;CLEAR R5,R4
        MOV     R5,A
        ADD     A,#08H      ;NO. OF LOOPS
        MOV     R3,A        ;USE R3 AS INDEX
LP      MOV     A,R5        ;GET RESULT LSB
        RLC     A           ;ROTATE 1 BIT LEFT THRU CY
        MOV     R5,A        ;SAVE LSB
        MOV     A,R4        ;GET MSB
        RLC     A           ;ROTATE IN CY
        MOV     R4,A        ;SAVE MSB
        MOV     A,R0        ;GET R6 VALUE
        JB7     ADD1        ;IF BIT 7=1 THEN ADD R1
        RL      A           ;IF =0 SHIFT LEFT NO ADD
        MOV     R0,A        ;RESTORE SHIFTED VALUE IN R0
        JMP     TT          ;GO TO TEST IF DONE

ADD1    RL      A           ;SHIFT LEFT
        MOV     R0,A        ;SAVE R0 SHIFTED VALUE
        MOV     A,R5        ;GET RESULT LSB
        ADD     A,R1        ;ADD R1
        MOV     R5,A        ;SAVE LSB
        CLR     A
        ADDC    A,R4        ;ADD CY AND R4 MSB
        MOV     R4,A        ;SAVE MSB
TT      DJNZ    R3,LP       ;DECR INDEX,IF NONZERO LOOP AGAIN
URK     MOV A,R5                    ;move result from R5 to R1 (lsb)
        MOV R1,A
        MOV A,R4                    ;move result from R4 to A (msb)
        MOV R2,A                    ;move msb to R2
        MOV SLASK,#TEMP3
        MOV A,@SLASK                ;pull register 3,4,5
        MOV R3,A
        INC SLASK
        MOV A,@SLASK
        MOV R4,A
        INC SLASK
        MOV A,@SLASK
        MOV R5,A
        MOV A,R2                    ;move result to A (msb)
        CLR C                       ;clear carry flag
        RET                         ;IF 0 DONE
```

```
READI

        MOV SLASK,#CHVLT            ;load chuck voltage into garbage
        MOV A,@SLASK
        ADD A, #03                  ;adjust for very low voltage
        MOV GARBAGE,A
        MOV SLASK,#CNLVL1           ;load cnlvl into a
        MOV A,@SLASK                ;mul varlvl and cnlvl
        CALL MULAG
                                    ;result is the most significant
                                    ;bytes current trechold
        CPL A                       ;take crlvl-cthold
        MOV SLASK,#CRLVL
        ADD A,@SLASK                ;+crlvl - cthold
        JC NTZR                     ;carry = crlvl > cthold
        ORL P2,#%00100000           ;if crlvl<cthold then open relay
        JMP ZR
```

```
NTZR    CLR C                       ;next 3 instructions test if
                                    ;hysterysis conditions are met
                                    ;to close relay.
        ADD A,#$F9                  ;data sets hysterysis level.
                                    ;+crlvl - cthold - #7 > 0.
        JNC ZR                      ;if condition is not met do not
                                    ;close relay.

        MOV A,@SLASK
        MOV SLASK,#CNLVL2
        CPL A
        ADD A,@SLASK
        JC NTC

        ANL P2,#%11011111           ;if crlvl>cthold then close relay
        JMP ZR

NTC     ADD A,#$F8
        JNC ZR
        ORL P2,#%00100000

ZR      RET


ZCRSUB  SEL RB1                     ;Entered by zerocrossing interrupt
        MOV TRACH,A                 ;Push the value of the accumulator
        ANL P1,#%11111110           ;Reset the d flip flop e.i reset
        ORL P1,#%00000001           ;zerocrossing interrupt
        MOV A,T
        MOV MAXDLY,A                ;save timer value at zero crossing in R7
        CLR A
        MOV T,A ;clear timer
        SEL RB0
        MOV A,REREG
        JZ INPNK
        ORL A,#%00001000
        MOV REREG,A
INPNK   SEL RB1
        ANL A,#$80                  ;Test ynfire
        JNZ FIRE
POPE    MOV SLASK,#TIMER
        MOV @SLASK,#1               ;If ynfire=0 then load 1 into timer
        DIS TCNTI                   ;and disabel timer interrupt
        JMP DNTFIRE                 ;If ynfire =1 then
FIRE    MOV SLASK,#TIMER
        MOV A,@SLASK                ;Move the value from adc to acc.
        MOV T,A
                                    ;T is the timer used as a counter to
        ;SCR firing delay.
        STRT T                      ;Start timer
        EN TCNTI
DNTFIRE MOV GARBAGE,#ADCAD
        MOV @GARBAGE,#0
        CALL READADC                ;Read the current
        MOV SLASK,#CRLVL
        MOV @SLASK,A
        ADD A,#PNKCUR               ;Add 4BH to test if the read current
        JNC NPANIC                  ; are higer then Imax
                                    ;prevent firing of the scr's

PANIC   CALL READADC                ;read current again
        ADD A,#PNKCUR
        JNC NPANIC                  ;jump out if second reading is lower
        SEL RB0
        DIS TCNTI                   ;Disabel timer interrup if panic
        MOV REREG,#0                ;set panik mode
        MOV SLASK,#PORT1            ;turn on lights so they blink
        MOV @SLASK,#%11110000
        MOV STREG, #%00010010       ;to select residual mode
        MOV SLASK, #TRESID
        MOV @SLASK,#$80             ;indicate that tresid has
                                    ;been done so no magnetization
                                    ;will take place
```

```
        SEL RB1
NFHNIC  MOV SLASK,#NCYCLE
        MOV A,@SLASK
        DEC A
        MOV @SLASK,A
        MOV A,TRACH
        SEL RB0
        RETR

                                ;END of ZEROCROSSING SUBRUTIN
TINTSUB
                                ;Timer interupt subrutin
                                ;Timer/counter interrupt vector here
        SEL RB1
        MOV TRACH,A
        SEL RB0

        MOV A,REREG
        ANL A,#$80
        JZ NFIRE
OUTSCR
        JF0 NEG
        ANL P2, #%01111111      ;bit 7 selects positive direction
                                ;SCR's when low Other bits of P2 are
                                ;unchanged.  bit 7 selects neg dir
                                ;SCR's when hi, which is default
                                ;state.
NEG
        ANL P2,#%10111111       ;bit 6 fires the selected SCR
                                ;when low.

        NOP
        NOP                     ;two instruction delay.
        ORL P2,#%11000000       ;make bit6 hi to turn off
                                ;SCR pulse.

        ;NOTE: the following instruction sets the length of the
        ;delay between pulses.  the length in microseconds is equal
        ;to 5 times the operand plus 10 usec

        ;       MOV TRACH,#18
        ;DELAY

        ;       DJNZ TRACH, DELAY
                ; loop until R2 is decremented to zero.

        ;       ANL P2,#%10111111       ;bit 6 fires the selected SCR
                                ;when low.

        ;       NOP
        ;       NOP                     ;two instruction delay.
        ;       ORL P2,#11000000B       ;make bit6 hi to turn off
                                ;SCR pulse. bit 7 is hi as default
NFIRE   STOP TCNT               ;Stops the counter
        SEL RB1
        MOV A,TRACH
        SEL RB0                 ;Select registerbank
        RETR

                                ;END of TIMER INTERRUPT SUBRUTIN
        ORG $3F0                ;Tabel of constants 1/(2+nstps)
TCONST1
        DB $94
        DB $55
        DB $3D
        DB $33
        DB $2A
        DB $22
        DB $21
        DB $1D
        DB $19
        DB $18
        DB $15
        DB $13
```

```
DB $12
DB $11
DB $10
DB $0F

END
```

What is claimed is:

1. Apparatus for demagnetizing a work piece of unknown characteristics using a winding which is magnetically coupled to the work piece by means of the application of a sequence of successively reducing current levels in successive phases of operation, the polarity of the current being reversed in successive phases; said apparatus comprising:

triggerable current switching means for applying direct current of a selectable polarity to said winding from alternating current supply mains;

means for controlling said switching means during a first portion of each phase of said demagnetizing sequence for applying a respective preselectable voltage to said winding and operable during a second portion of each phase for controlling said switching means to provide late triggering thereof to provide an average voltage which opposes the current flow induced during the first portion thereby to quickly reduce the level of current flowing in said winding.

2. Apparatus as set forth in claim 1 wherein said triggerable current switching means comprises first and second pluralities of silicon controlled rectifiers, each plurality being arranged as a full-wave bridge for providing current to said winding in a respective direction.

3. Apparatus for demagnetizing a work piece of unknown characteristics using a finding which is magnetically coupled to the work piece by means of the application of a sequence of successively reducing current levels in successive phases of operation, the polarity of the current being reversed in successive phases; said apparatus comprising:

triggerable current switching means for applying direct current of a selectable polarity to said winding from alternating current supply mains;

means for controlling said switching means during a first portion of each phase of said demagnetizing sequence for applying a respective preselectable voltage to said winding and operable during a second portion of each phase for controlling said switching means to provide late triggering thereof to provide an average voltage which opposes the current flow induced during the first portion thereby to quickly reduce the level of current flowing in said winding;

means for sensing the level of current in said winding and generating a control signal representative thereof;

means responsive to said control signal and operative when the current in said winding falls below a preselectable value during the latter portion of each phase in the demagnetizing sequence for terminating the late triggering of the triggerable switching means and for initiating the application of voltage for inducing current in the reverse direction at the next lower level of current to begin the first portion of the next phase of the demagnetizing sequence.

4. Apparatus as set forth in claim 3 wherein said current sensing means comprises a current transformer responsive to the power drawn from said alternating current supply mains by said triggerable current switching means.

5. Apparatus as set forth in claim 4 wherein said current switching means comprises rectifier means and filter means interconnected with said current transformer for providing a d.c. voltage representative of the current in said winding.

6. Apparatus as set forth in claim 5 wherein the means responsive to said control signal is a micro-computer and wherein said apparatus further comprises analog to digital conversion circuitry for providing to said micro-computer a digital value representative of said d.c. voltage.

7. Apparatus as set forth in claim 6 wherein said triggerable current switching means comprises first and second pluralities of silicon controlled rectifiers, each plurality being arranged as a full-wave bridge for providing current to said winding in a respective direction.

8. Apparatus for demagnetizing a work piece of unknown characteristics using a winding which is magnetically coupled to the work piece by means of the application of a sequence of successively reducing current levels in successive phases of operation, the polarity of the current being reversed in successive phases; said apparatus comprising:

triggerable current switching means for applying direct current of a selectable polarity to said winding from alternating current supply mains;

a micro-computer for controlling said switching means during a first portion of each phase of said demagnetizing sequence for applying a respective preselectable voltage to said winding and operable during a second portion of each phase for controlling said switching means to provide late triggering thereof to provide an average voltage which opposes the current flow induced during the first portion thereby to quickly reduce the level of current flowing in said winding;

means for sensing the level of current in said winding and generating a control signal having an amplitude representative of said current level;

analog to digital conversion circuitry for providing to said micro-computer a digital value representative of said amplitude, said micro-computer being operative when said digital value falls below a preselectable value during the latter portion of each phase in the demagnetizing sequence for terminating the late triggering of the triggerable switching means and for initiating the application of voltage for inducing current in the reverse direction at the next lower level of current to begin the first portion of the next phase of the demagnetizing sequence.

* * * * *